United States Patent [19]

Schlag et al.

[11] Patent Number: 4,570,066

[45] Date of Patent: Feb. 11, 1986

[54] METHOD AND DEVICE FOR PRODUCING MOLECULAR BEAMS

[76] Inventors: Edward W. Schlag, Osterwaldstrasse 91, 8000 Müchen 40; Hanns von Weyssenhoff, Rehmerfeld 21, 3000 Hannover 51; Heinrich Selzle, Römerhofweg 51c, 8046 Garching, all of Fed. Rep. of Germany

[21] Appl. No.: 598,329

[22] PCT Filed: Jun. 30, 1983

[86] PCT No.: PCT/DE83/00118

§ 371 Date: Mar. 5, 1984

§ 102(e) Date: Mar. 5, 1984

[87] PCT Pub. No.: WO84/00276

PCT Pub. Date: Jan. 19, 1984

[30] Foreign Application Priority Data

Jul. 2, 1982 [DE] Fed. Rep. of Germany ..... 3224801

[51] Int. Cl.[4] ..... H05H 3/02

[52] U.S. Cl. ..... 250/251; 250/288

[58] Field of Search ..... 250/251, 288, 281, 282

[56] References Cited

U.S. PATENT DOCUMENTS 4,091,256 5/1978 Früchtenicht ..... 219/121 L 4,259,572 3/1981 Brunnee et al. ..... 250/281

OTHER PUBLICATIONS

Smalley et al, *Accounts of Chemical Research,* vol. 10, 1977, pp. 139–145.

Adams et al, *Review of Scientific Instruments,* vol. 52, No. 10, Oct. 1981, pp. 1469–1472.

Postumus et al, *Analytical Chemistry,* vol. 50, No. 7, Jun. 1978, pp. 985–991.

Cotter, *Analytical Chemistry,* vol. 52, No. 14, Dec. 1980, pp. 1589A–1606A.

Henke et al, *Chemical Physics Letters,* vol. 77, No. 3, Feb. 1981, pp. 448–451.

Fung et al, *Z. Naturforsch,* vol. 36a, 1981, pp. 1338–1339.

Hays et al, *Z. Naturforsch,* vol. 35a, 1980, pp. 1429–1430.

*Primary Examiner*—Alfred E. Smith

*Assistant Examiner*—Jack I. Berman

*Attorney, Agent, or Firm*—McCormick, Paulding & Huber

[57] ABSTRACT

The present invention relates to a method and apparatus for producing molecular beams which contain large, thermally unstable molecules. The molecules are transformed from the nongaseous to the gaseous phase with the application of energy, and are mixed with a carrier gas and then adiabatically cooled with the carrier gas through an expansion process. Thus, the large molecules are transformed from the nongaseous to gaseous phase at such a temperature that their vaporization rate is larger than their disintegration rate. The energy for transforming the large, thermally unstable molecules from the nonvolatile to the gaseous phase is generated so fast that the large, thermally unstable molecules are transformed from the nonvolatile to the gaseous form at a temperature lying above the disintegration temperature. At this temperature, the vaporization rate is larger than the disintegration rate whereby the molecules are directly broken down in an expanding carrier gas beam whose temperature is substantially less than the vaporization or correspondingly the disintegration temperature of the large, thermally unstable molecules. The molecules are broken down into a gaseous form in those areas of the carrier gas beam in which the beam begins to expand (FIG. 3).

13 Claims, 12 Drawing Figures

METHOD AND DEVICE FOR PRODUCING MOLECULAR BEAMS

Figure 1:
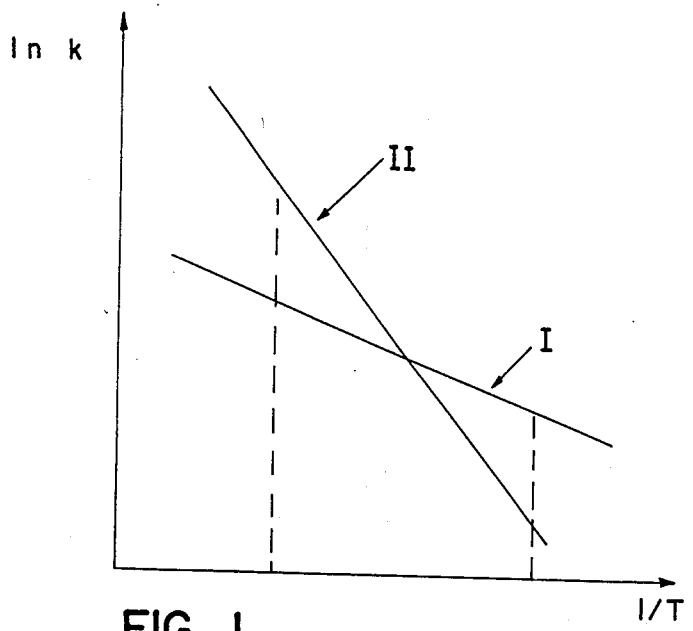

The invention relates to a method for producing molecular beams in which a test substance is transformed (vaporized) from a non-gaseous phase to a gaseous phase through the introduction of energy, the free molecules generated from the transformation of the test substance being mixed with a carrier gas and the carrier gas with the molecules of the test substance being cooled adiabatically through expansion in a beam of the carrier gas.

The invention relates further to an apparatus for accomplishing the above-mentioned method comprised of a gas beam jet for producing the beam of carrier gas, a device for introducing the carrier gas into the gas beam jet, an evaporator and mixing chamber for transforming a test substance from the nongaseous phase into the gaseous phase (vaporization), and for mixing this phase with the carrier gas, and an energy-producing device for introducing the energy for evaporation into the evaporator and mixing chamber.

A method and apparatus of this type well known, as is found for example, in the US-Z Chemical Physics Letters, Vol. 77, No. 3, Pages 448–451.

According to the present state of the art, desired molecular beams can be produced, which consist of a carrier gas, generally noble gas, for example, argon, and molecules mixed with the carrier gas inasmuch as these molecules are from a volatile substance which evaporates at a particular temperature at which the molecules definitely do not disintegrate, that is, insofar as thermally stable molecules are concerned.

In particular, according to the state of the art, molecular beams are produced by means of a method and an apparatus of the above-mentioned type which is well known only for thermally stable molecules. In this process, the molecule is evaporated or otherwise vaporized in a carrier gas atmosphere, for example, in an argon atmosphere, and after the formation of a molecular beam by means of a gas beam jet, the molecules are cooled through an adiabatic expansion, so that they thereby achieve a very low temperature, which is especially suitable for analysis by means of mass spectroscopy or other molecular or ionic investigation methods.

The evaporation of the molecules mixed in the carrier gas takes place in the above-mentioned evaporation and mixing chamber upstream of the gas beam jet in the chamber directly before the gas beam jet through which the mixture of the molecules to be analyzed and the carrier gas flows, and the gas beam is formed. This is effective inasmuch as the volatile substance which comprises the analyzed molecules or which the molecules contain is not automatically vaporized due to its vaporization pressure at room temperatures.

The preferred methods by means of which such molecular beams are analyzed are investigations by means of tuned laser beams either in fluorescent materials or by mass spectroscopic multi-photon ionization (MPI). The above-mentioned methods and apparatus for accomplishing these processes are not suitable for thermally unstable molecules; this is for nonvolatile molecules which disintegrate with heating before they have reached an adequate vaporization pressure.

For analysis of thermally unstable molecules, it has not been possible until now to produce molecular beams, but vaporization of such thermally unstable molecules has taken place directly in a vacuum, that is, without a carrier gas, whereby these thermally unstable molecules are more or less destroyed. In connection with the vaporization, there is produced an ionization and an analysis through ionization inspection methods as, for example, mass spectrometry methods.

For one such vaporization and ionization of thermally unstable molecules, there have been developed in recent times a series of methods by which these thermally unstable molecules are directly vaporized through ionization in a vacuum to be investigated by mass spectrometry. Some of the most important methods given here as examples are as follows: the spark discharge pyrolyzation, the spraying of a solution (electrospray) with immediate vaporization of the solution material, the field desorption and ionization, chemical ionization, the bombardment with high speed atoms, and the laser desorption. All of these method have been employed for direct ionization of thermally unstable molecules with various results. They have one important advantage that ions are produced and besides these, there are in part fragments and in part combination ions, whereby very often parent molecules formed by cationization occur, that is, parent ions to which another ion has been attached, for example, a proton or an alkali ion. By this means, the same fragmented pieces and joined complexes are not always formed so that conclusions about the destroyed molecules, for which the real analytical results should be obtained, are difficult, not as certain, and almost impossible. It may also be that with most of the mentioned methods, neutral molecules in an undestroyed condition are also jointly vaporized, in particular, with laser vaporization, even though until now it has been not possible to accurately authenticate or identify such thermally unstable molecules. Above all, these molecules have not been considered for molecular beams, and for the actual proof, they will still not be destroyed, for example, by ionization.

From the Magazine for Naturforschung, Vol. 36a 1981, Pages 1338–1339, and Vol. 35a, 1980, Pages 1429–1430, as well as the magazine "Chemical Physics Letters", Vol. 77, No. 3, Pages 448–451, there is actually known a method for producing a pulsed molecular beam; however, the beams produced by this actual method do not contain any thermally unstable molecules.

Just one of these methods described in the Magazine for Naturforschung, Vol. 36a, 1981, Pages 1338–1339, relates to the vaporization of a volatile substance which possesses a high vaporization pressure at room temperature, namely, vaporization of benzol. This substance is vaporized into a carrier gas that in the above-mentioned case is argon and, accordingly, will form a molecular beam from such a mixture whereby none of the difficulties are produced, such as were already mentioned above. For the method described in the magazine "Chemical Physics Letters", Vol. 77, No. 3, Pages 448–451, the same holds true and here only another volatile substance is involved, namely, Diacetyl. Apart from this, the pulsed molecular beam is produced in this process by means of a magnetic valve. In principle, the same can be said also for the method described in the Magazine for Naturforschung, Vol. 35a, 1980, Pages 1429–1430, however, with one variation, in that here the substance which forms the molecular beam is heated. In this instance, the transformation of the substance into the gaseous phase, which previously involved anthracene, was produced by heating to a temperature which lies well below the distintegration temperature.

In the formation of a molecular beam from the volatilized substance-carrier gas mixture, according to the method as has been described in the Magazine for Naturforschung, Vol. 36a, 1981, Pages 1338–1339; Vol. 35a, 1980, Pages 1429–1430, firstly, after the molecular beam has been produced, this beam is formed as a by-product complex of the mentioned substance with the carrier gas. These complexes are definitely not available before the formation of the molecular beam, particularly prior to the cooling by means of expansion of the carrier gas beam, but in contrast, are formed as a direct result of the sharp cooling. These complexes, which are generally not associated with large thermally unstable molecules, are under normal conditions, nonexistent, and are only of interest insofar as very weak Van der Waals alternating forces can be investigated thereby. With the foregoing invention, in contrast, such molecular beams are produced with large thermally unstable molecules under normally existing conditions. These kinds of molecules can never be formed initially in the molecular beam through association, as in the case of the above-mentioned complexes, but they must be brought into a molecular beam as such.

Further, large thermally sensitive molecules for experimentation are known from U.S. Pat. No. 4,259,572; however, the substance which contains these molecules, not in the form of neutral molecules, but more often in the form of molecular ions, is transformed into the gas phase. The method, according to this method, offers a considerable advantage in that there are no undamaged, large thermally unstable molecules to be investigated in the gaseous phase. In regard to this method, the above mentioned embodiments are preferred over the methods developed in recent times for vaporization and ionization of thermally unstable molecules.

Finally, a method and apparatus are described in U.S. Pat. No. 4,091,256 in which a substance produces so much energy that the substance disintegrates into single atoms and delivers such a beam of neutral atoms. With this method and this apparatus, large thermally unstable molecules definitely cannot be transformed into the gaseous phase without disintegration.

It should be understood that a non-volatile substance is one which is non-volatile under normal conditions, 20° Centigrade at one atmosphere.

At the temperature at which anthracene evaporates according to the method described in the Magazine for Naturforschung, Vol. 36a, 1981, Pages 1338–1339, there is a balance of solid anthracene and anthracene vapor.

The invention has as one object an improved method of the type described above which makes it possible to bring large thermally unstable molecules, that is, molecules from vaporizable substances without disintegration and undamaged into a molecular beam which is used for spectroscopic purposes, in particular for mass spectroscopy.

This object, according to the present invention, is achieved through the above-mentioned method, so in such a manner that for production of the molecular beam with large thermally unstable molecules, the energy is generated in pulse form at such a high level that the test substance is quickly vaporized as it disintegrates, the temperature of the gas carrier beam in the region of the beam in which it begins to expand is adjusted to substantially less than the disintegration temperature of the test substance, and the molecules set free from the test substance are brought directly into this region of the gas carrier beam.

The basic object is further achieved according to the apparatus mentioned above, in such a manner that for producing a molecular beam which contains the large thermally unstable molecules, the device generating the carrier gas generates such gas upstream from the gas beam jet at a temperature which is substantially less than the vaporization temperature, that is, the disintegration temperature of the test substance, the vaporization and mixing chamber is positioned at least with the part in which the mixing of the molecules and the carrier gas takes place downstream from the exit opening of the gas stream jet, as well as adjacent the same, and the energy-generating device yields a high level of energy in an impulse fashion.

In the framework of the foregoing invention, molecules of a thermally unstable type should be understood to be from a substance in which the molecules are disassociated at temperatures far below the vaporization temperatures. These substances therefore have a vaporization pressure which lies far below those vaporization pressures which would be necessary to transform the molecules into the gaseous phase at room temperature. The term large molecules should, in the context of the present invention, be especially understood in particular to be molecules having molecular weights amounting to 100 or more.

According to the method of the present invention, the vaporization of the molecules results therefore under conditions at which more non-disintegrated molecules are found in the gaseous phase than those corresponding molecules at the thermodynamic equilibrium point of the prevailing temperature, while in the condition of thermal equilibrium in the case of substances which consist of large thermally unstable molecules, absolutely no undestroyed molecules are available.

In the novel method and apparatus according to the invention, two essential processes take place in combination on the basis of the concept of the invention whereby the production of molecular beams with undestroyed, large thermally unstable molecules is made possible.

(1) Vaporization of the substance which consists of the large thermally unstable molecules or which contains these molecules takes place very fast, and, as a result, the vaporization is so fast that the main portion of the molecules are not thereby destroyed. Such a fast vaporization is well known as will be further described in connection with FIG. 1; however, still not disclosed is the possibility alone of producing the desired molecular beam, which contains large thermally unstable molecules in an undecomposed condition, because the vaporized molecules decompose shortly after the vaporization into the gaseous phase, as a result of the energy absorbed by the vaporization.

(2) The second reaction is that the vaporized, thermally unstable molecules are set free immediately after their vaporization by dissipation of heat in the carrier gas beam since they are mixed with the expanding carrier beam whose temperature is substantially less than the vaporization or disintegration temperature of the large thermally unstable molecules, and in those same regions of the cool carrier gas beam in which the beam begins to expand.

This prevents the thermally unstable molecules from being harmed subsequent to the transformation into the gaseous phase. The resulting "stabilized cooling" here is to be distinguished from the adiabatic cooling which does not occur until later and which has quite another purpose which is to cool the molecules that are being studied to an analyzation temperature of a few degrees Kelvin.

It seems that at this point important to point out that in the current state of the art by which the molecules in the carrier gas atmosphere, for example, an argon atmosphere, are vaporized upstream of the gas beam jet, as was already mentioned, the carrier gas is "hot" as a result of the fact that the molecules to be investigated are heated in association with the reaction of thermal vaporization, and thereby the reaction contributes to the decomposition of the thermally unstable molecules. Firstly, after the carrier gas and the vaporized molecules are mixed in the vaporization and mixing chamber in the case of a thermal vaporization at relatively high temperatures, the thermally unstable molecules are damaged by such mixing. Even if a certain percentage of non-decomposed molecules should be vaporized, the molecules to be investigated expand in association with the carrier gas through the gas beam jet. As a result, it is, according to the state of the art, not possible to produce molecular beams which contain non-decomposed large thermally unstable molecules.

In contrast to this, the present invention makes possible the production of molecular beams in which the large thermally unstable molecules are not destroyed and stand ready for various experimental purposes, in particular, for optical spectroscopy, for kinetic reactions that are employed in known manners in the outer regions of a molecular beam for experimental purposes, as well as for mass spectrometry. In the context of the invention, the words "evaporated" or "vaporization" or "evaporation" should be understood to mean all kinds of transformations of molecules into the gaseous phase. This transformation, therefore, can result from a solid substance which contains the molecules to be investigated or consists of the molecules as well as also from the outer surface on which the molecules are accumulated or absorbed.

Preferably, the large thermally unstable molecules are vaporized by means of a laser beam. This kind of vaporization has the advantage that it favors the possibility of producing a very rapid vaporization of the large thermally unstable molecules as a result of the relatively high temperatures.

A further preferred embodiment of the method according to the present invention is distinguished by the fact that the large thermally unstable molecules are vaporized by means of a vaporization impulse, just as in the gas carrier beam impulse. For this reason, the molecules can be examined very well, except that the substance from which they are vaporized is continuously heated and is for the most part destroyed. It is much preferred that only the upper surface of the substance be heated to a temperature level providing rapid vaporization.

In order that the large thermally unstable molecules get admitted directly into the existing relatively cool carrier gas beam at the beginning of its expansion after they are transformed into the gaseous phase, they are vaporized from a test surface extending substantially parallel to the axis of the gas beam carrier adjacent the exit opening of the gas beam jet, this test surface not extending into the gas carrier beam in order that an undisturbed expansion of the gas beam is possible.

The device for accomplishing the novel method, as already described above in its basic construction, is so formed that large thermally unstable molecules are immediately set free after their entry into the gaseous phase of the mentioned stabilized cooling. The vaporization position is located laterally of the exit opening of the gas stream jet by a distance which is smaller than or equal to the 20 times the effective diameter of the exit opening. The lengthwise distance is that along the axis of the gas beam jet and the effective diameter is the diameter of an equivalent circular exit opening. If therefore the exit opening of the gas stream jet has an annular cross section, then the diameter of the circular exit opening is to be understood to be less than the effective diameter in the above sense which provides the same cross sectional area as the annular exit opening.

Further, and likewise for the purpose of guaranteeing a stabilization cooling as fast as possible, the vaporization position is located transversely of the axis of the gas beam jet by a distance which is equal to or less than 20 times, preferably 10 times, the effective diameter of the exit opening.

It should especially be noted that the transverse distance is smaller than half the lengthwise distance.

The apparatus can be further formed so that the vaporization and mixing chamber comprises preferably a cylindrical expansion chamber for the carrier gas beam upstream and adjacent of the exit opening of the gas stream jet, the vaporization position being provided at or in the walls. This vaporization position can in particular be provided with a test canal that is positioned at an angle, preferably perpendicular to, the axis of the gas stream jet. The canal is formed in the lateral wall of the expansion chamber. With this construction, a laser beam can be formed which lies in an axial extension of the test canal in the lateral walls of the expansion canal if vaporization is produced by means of a laser beam. The distance of the outer test surface from the lateral walls of the expansion chamber is preferably smaller than or equal to the diameter of the test canal whereby the test diameter is preferably the same as the diameter of the test canal.

The invention will be described below with reference to FIGS. 1–12 of the drawings with the aid of a special preferred embodiment and the experimental results achieved thereby.

(1) FIG. 1 is a graphical illustration showing the relationship between vaporization and disintegration of large thermally unstable molecules.

Figure 2:
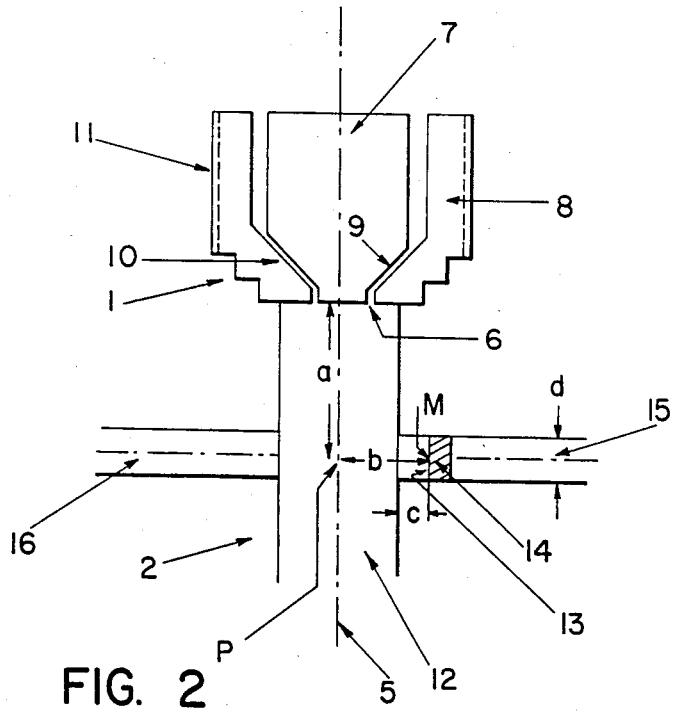

(2) FIG. 2 is the lengthwise section through a gas beam jet and a portion of a vaporization and mixing chamber as they are preferably employed for accomplishing the method of the present invention.

Figure 3:
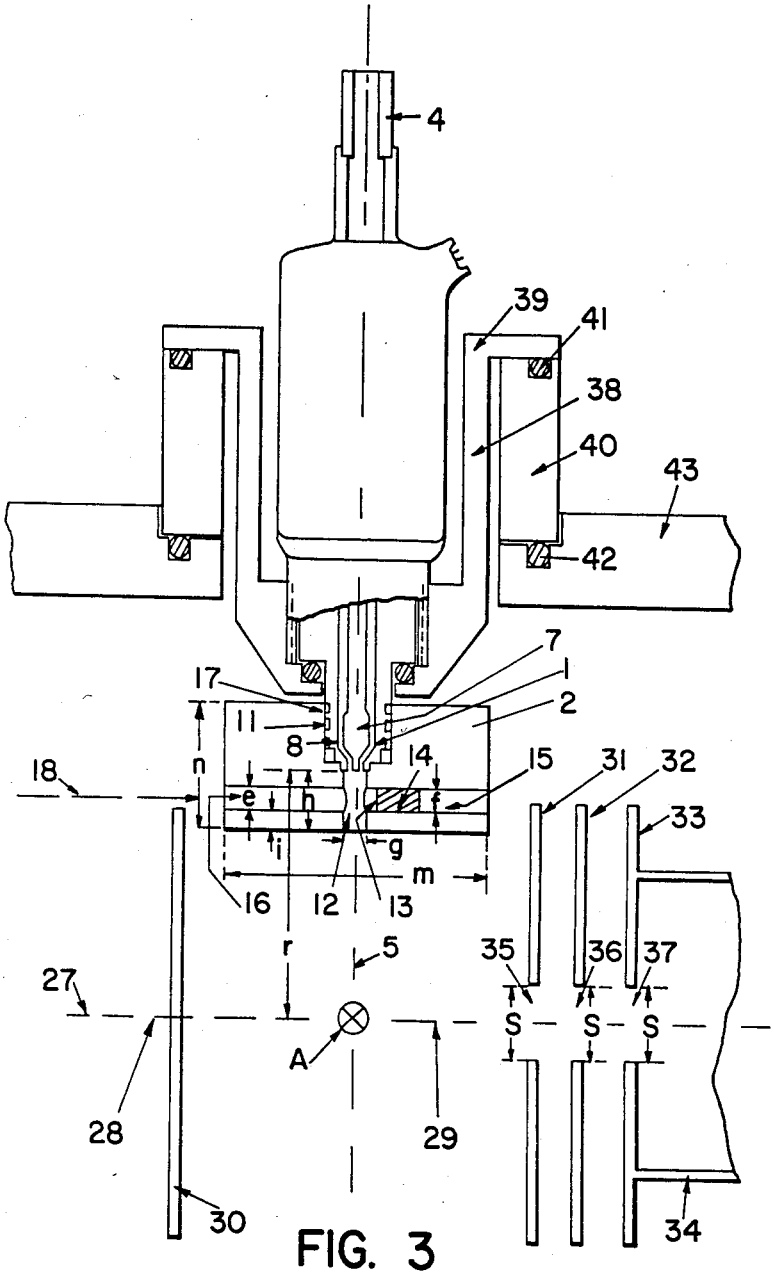

(3) FIG. 3 is an illustration of a preferred embodiment of the apparatus according to the invention with the connecting field plate of a mass spectrometer; however, without the apparatus with which the vaporization energy is generated in the test occurring in the vaporization and mixing chamber.

Figure 4:
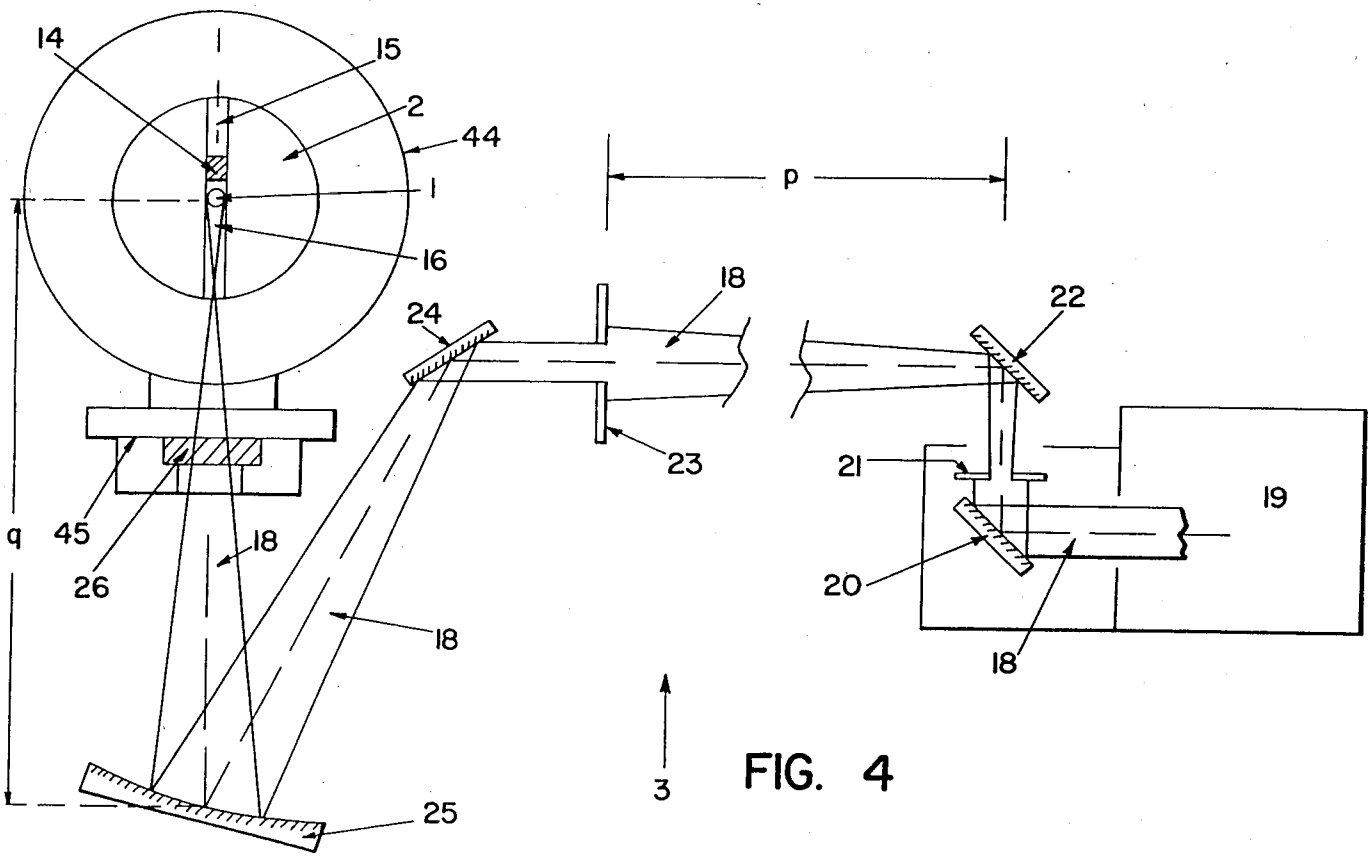

(4) FIG. 4 is an embodiment of the apparatus with which the vaporization energy is produced and generated for the test, and (5) FIGS. 5–12 are graphs of the experimental results which are achieved by means of the method and apparatus of the invention.

It can first of all be seen in FIG. 1 that the natural logarithms of the reaction constant k for disintegration (Level I) and for vaporization (Level II) are illustrated schematically with reference to the reciprocal value of the absolute temperature T. This is shown according to the work of R. J. Cotter entitled "Mass Spectrometry of Non-volatile Compounds" in Analytical Chemistry 52 (1980) 1589A. Thus, with large thermally unstable molecules, vaporization has a higher activation energy than disintegration; therefore, the rate of vaporization increases with temperature faster than the disintegration temperature. Accordingly, the vaporization rate becomes larger than the disintegration rate at a particular temperature level, namely, at the intersection of the two levels I and II, and upward to higher temperatures.

Thus, if one moves very rapidly up to a very high temperature, most of the molecules are vaporized before they have assimilated sufficient energy in the internally resonant mode which can lead to disassociation. Besides these two partially neutrally occurring reaction methods, there are various ionization methods which, with others, lead to the already referred to energetically favorable cationized "species".

The vaporization or evaporation of thermally unstable molecules can be produced by very fast heating from the outside and can be caused by means of a very short laser impulse with high power. The division of energy among the three vaporization processes, evaporation, disintegration, and ionization, by bombardment with a laser beam, depends primarily on the following factors: laser energy level, the impulse duration, and the quality of the specimen. The effect of wave length of the laser beam on a vaporization process appears to be of minor importance; it is, however, not precluded that specific tests with particular wavelengths, for example, in the infrared region can produce specially high vaporization rates (resonant disorption). From this standpoint, the $CO_2$ laser (Wavelength 10.6 um) is preferred before the alternative Neodym-YAG-Laser (Wavelength 1.06 um) because with 10.6 um, most of the large organic molecules possess a resonant band that does not exist at 1.06 um.

A molecular beam is a collective stream of molecules which moves apparently without collisions in a preferential direction. The absence of collisions is also achieved with free expansion in a vacuum, but here there is no preferred direction. In the method according to the present invention, the vaporized molecules are mixed with a gas carrier beam immediately after the exit of a pulsed gas beam jet. By this means, the still "hot" molecules firstly encounter collisions with the carrier gas atoms and are deactivated thereby through a stabilization cooling so that the probability of a subsequent unimolecular catastrophy is strongly decreased. Through further adiabatic expansion, the initial jet beam is transformed into a molecular beam in a short distance.

With the aid of FIGS. 2–4, an especially preferred embodiment of the apparatus according to the invention is described further. This apparatus for the generation of a pulsed doped molecular beam consists above all of the following four components.

(1) A gas beam jet 1, which is presently formed in the preferred embodiment as an electromagnetic pulsed jet valve, and serves to generate a carrier gas beam, for example, an argon beam;

(2) A vaporization and mixing chamber 2 for mixing of vaporized molecules from a specimen with the gas carrier beam; and (3) An energy generation device 3 for the generation of vaporization energy for the vaporization and mixing chamber 2 in which the principal component is a pulsed $CO_2$-laser (TEA-laser); as well as (4) A carrier gas generation device 4 for the generation of the carrier gas in the gas beam jet 1; only the connecting stub of this carrier gas generating device 4 is illustrated in the drawings, namely, in FIG. 3, and through this stub, the carrier gas is transmitted to the gas beam jet 1.

By means of these four components which compose the preferred embodiment and which are described in greater detail below, a molecular beam is produced of which only the axis 5 is illustrated. This axis is simultaneously the axis of the gas beam jet 1 and accordingly also of a carrier gas beam separating from the jet as well as the axis of the mixing gas beam comprised of the carrier gas beam and the molecules vaporized into the beam. The molecular beams comes from the mixed gas beam after an adiabatic expansion.

To establish the properties of the molecular beam, a flight time mass spectrometer with a laser multi-photon-ionization is presently provided. In the lower part of FIG. 3, a plurality of field plates and a portion of the drift duct of the mass spectrometer are clearly shown. The ionizing laser is a tuned color laser, which is pumped from a Q-switch Neodym-YAG-Laser.

The impulse generator for the jet beam (here the whole beam is shown which becomes the molecular beam derived from the carrier gas beam by means of the mixing gas beam) is not an absolutely necessary feature of the novel method; however, it has an exceptionally important, practical meaning for the preservation of an adequate vacuum with reasonable pump expense. Besides a continuous carrier gas beam, for example, from argon, would make no practical sense with the pulsed vaporization. It is important for the functioning of the method that there be a precise time correlation of the jet beams, that is, of the vaporization pulse from the laser and the ionization laser pulses, and these are accomplished through standard electronic switching standards.

In the following text, the individual components are described further together with exemplary structural dimensions, as well as preferred optimum operating data.

As the first of these components, the gas beam jet is described in detail with the aid of FIGS. 2 and 3.

The gas beam jet 1 is formed as a jet valve and accordingly is in the foregoing instance a commercial electromagnetically operated valve from the firm of Bosch. This valve was originally intended for operation of the fuel system of a fuel injected engine. This jet valve has an annular exit opening 6, which is bounded on the inside by the cylindrical end of a valve poppet 7 and outside by the cylindrical opening of the valve seat cylinder 8. A conical valve surface 9 at the cylindrical end of the valve poppet 7 is associated with the inside of the gas jet and cooperates with a complimentary conical valve seat surface 10 which connects with the cylindrical opening of the valve seat cylinder 8. The jet valve is modified so that the valve seat cylinder 8 is freely accessible and is provided with exterior threading 11 for threading engagement with the vaporization and mixing chamber 2.

In the present embodiment, the annular exit opening 6 has a radial width of approximately 0.1 mm and an outside diameter of approximately 1 mm so that a corresponding annular carrier gas beam is produced. The distance between the valve surface 9 and the valve seat surface 10 in the open condition of the jet valve amounts to approximately 0.1 mm. The jet valve is operated electromagnetically by a carrier gas impulse of approximately one second duration with a rise and fall time of approximately 200 usecs. This is achieved through an electrical impulse of 500 usecs, which is applied to the electromagnetic coils of the jet valve.

The vaporization and mixing chamber 2 is described next also with the aid of FIGS. 2 and 3. The mixing chamber, at least with regard to its essential parts in which the vaporization and mixing takes place is positioned upstream of the exit opening 6 for the gas beam jet as well as adjacent to this opening.

The vaporization and mixing chamber consists of a cylindrical expansion canal 12 for the carrier gas beam which has an axis coaxial with the axis 5 of the jet beam. The canal 12 forms a further downstream extension of the exit opening 6 and connects as well at its one end directly to the exit opening 6. The other end of the expansion canal extends into the vacuum for further expansion of the jet beam.

At or in the walls of the expansion canal 12 is a vaporization position 13 which in the present case is formed from an upper surface of a specimen 14 that has been pressed into a pill configuration. This vaporization location 13 is provided in a test canal 15 which is positioned perpendicular to the axis 5 of the gas beam jet 1 and is formed in a lateral wall of the expansion canal 12. The vaporization and mixing chamber 2 consists further of a laser beam canal 15 on the opposite side of the expansion canal 12. The vaporization energy is supplied by means of the laser beam canal 16 as is described further below with the aid of FIG. 4.

In order for an undisturbed expansion of the gas carrier beam to take place in the expansion canal 12, the diameter of this canal is substantially larger than the outside diameter of the exit opening 6. In order that the molecules of the specimen 14 will be vaporized for the purpose of stabilized cooling as much as possible directly in the expanding gas carrier beam, and as well as in the region of the beam which is as close as possible to the beginning of the expansion, the following conditions are preferably met:

1. The longitudinal distance a of the vaporization position 13 from the exit opening 6 of the gas jet is smaller than or equal to 20 times the effective diameter of the exit opening 6. With this, the distance between the exit opening 6 and the projection point P in the middle M of the vaporization position 13 on the axis 5 of the jet stream is understood to be less than the distance a. The concept of the effective diameter of the exit opening 6 was already explained in greater detail above.
2. The transverse distance b of the vaporization position 13 from the axis 5 of the jet beam is smaller than or the same as 20 times, but preferably ten times, the effective diameter of the exit opening.
3. The transverse distance b is preferably smaller than half of the longitudinal distance a.
4. The separation c of the vaporization position 13 from the lateral wall of the expansion channel 12 is smaller than or equal to the diameter d of the test channel 15 which preferably fills out or occupies the same cross section as the specimen 13.

In the present embodiment, the vaporization and mixing chamber 2 consists of a cylindrical block made of refined steel which has a concentric threaded bore 17 for the expansion canal 12. By means of this threading, the block is screwed onto the external threads 11 of the valve seat cylinder 8. The preferred dimensions of the cylindrical block, the expansion canal 12, as well as the test canal 15 and laser beam canal 16 which penetrate the expansion canal from the outer side of the cylinder block are as follows:

Diameter e of the laser beam canal—2.5 mm
Diameter d of the test canal—2.5 mm
Diameter g of the expansion canal—2.5 mm
Axial length a of the expansion canal—5 mm
Minimal distance i of the inner wall of the test and laser beam canal from the forward wall of the cylindrical block downstream of the gas beam jet—1.5 mm
Diameter m of the vaporization and mixing chamber—30 mm
Thickness n of the vaporization and mixing chamber—13 mm It should be noted that the vaporization and mixing chamber 2 can be modified in a manner such that a band or belt coated with the test on which the vaporizing laser beam 18 acts through the laser beam canal 16 and consisting, for example, of copper or teflon, can extend past the position of the pressed specimen 14 (see FIG. 4). In this manner, the outer surface from which the vaporization beam is ejected can be permanently renewed while the band is advanced continuously or in a stepwise fashion; however, this embodiment is not illustrated in the drawings.

Now, the energy generating apparatus 3 is described further. With this apparatus, the large thermally unstable molecules are vaporized at a temperature at which the vaporization rate of these molecules greater than the disintegration rate.

This energy generating apparatus 3 is comprised of a laser 19 as the energy source, which in the present case, is a pulsed $CO_2$-TEA-laser. This laser is delivered with a beam cross section of $2.3 \times 2.5$ cm, a vaporization laser beam impulse of 0.3 J/cm$^2$ and one microsecond duration. The repetition frequency is in the region of from 0 to 10 impulses per second and is variable. As is illustrated in the drawing of FIG. 4, which is not to scale, the vaporization laser beam 18 is reflected at an angle of 90° directly after its exit from the laser 19 by means of a first gold-plated flat reflecting mirror 20 and through a first iris aperture 21 to a second flat gold-plated mirror 22 as well as through a second iris aperture 23 and a third flat gold-plated reflecting mirror 22 to a similar gold-plated concave mirror 25. The two variable iris apertures, 21 and 23, are provided for restricting the vaporization laser beam 18 which, as shown in FIG. 4, is projected onto directly the iris aperture 21 from the exit of the laser 19 and onto the iris aperture 23 in the region of the third reflecting mirror 24.

By means of the concave mirror 25, the vaporization laser beam is concentrated through a window 26 into the interior of an evacuated space 27 within the vaporization and mixing chamber, as well as through the laser beam channel 16 onto the vaporization position 13, that is, onto the outer surface of the specimen 14. It is, however, to be noted that the specimen 14 is not located precisely at the focal point of the concave mirror 25.

Furthermore, the distance of the concave mirror from the vaporization position 13 can be varied and through this variation, the energy density of the beam 18 on the surface of the specimen 14 can be varied in a simple manner.

The following preferred data for the energy generating apparatus of FIG. 4 is provided:

Distance p between the two iris apertures: ca 2.5 m

Adjustment range of the distance q between the convex mirror and the vaporization position: 30–45 cm Focal distance of the convex mirror: 28 cm The window material: Bariumfluoride In order to investigate the molecular beam obtained in this manner in the flight-time mass spectrometer as mentioned above, the beam must be ionized. This takes place at the position in the FIG. 3 identified with A by means of an ionizing laser beam 28, which in FIG. 3, is clearly indicated in the plane of the drawing. However, it actually extends perpendicular to the plane of the drawing. For generating this ionizing laser beam 28, a Neodym-YAG-colored-laser system from the firm Quanta-Ray is suitable. This laser system operates optimally at an impulse repetition frequency of 10 Hz and delivers an impulse of approximately 10 nsec. duration. Since the basic wavelength of this YAG-laser, which lies at 1064 nm and has harmonics which extend upwardly to the fourth harmonic at 2066 nm, the entire region from approximately 800 to 240 nm can be covered by suitable selection of the colored material, as well as by doubling and frequency mixing. The ionizing laser beam 28 is focused on the intersection point A of the molecular beam and the ion optical axis 29 of the flight-time mass spectrometer by means of a lens which is not illustrated and which preferably has a width of 20 to 50 cm. This intersection point A is located in the present embodiment at a distance r of 2.5 cm from the exit opening 6 for the carrier gas beam.

In FIG. 3, as shown, the field plates 30–33 and a portion of the drift tube 34 of conventional flight-time mass spectrometer are shown. These components form an observation field for extraction of the ions produced at intersection point A, an individual lens and a drift space, whereby the last of these being separated from the molecular beam by means of apertures 35, 36, 37 provided in the field plates 31, 32, and 33. The apertures 35, 36, and 37 have, for example, a diameter s of actually 5 mm. At the end of the drift path, which amounts to for example 25 cm, a secondary electron multiplier is located, but not illustrated. The presence of ions is established by means of a preamplifier, preferably on a fast oscillograph or a TRANSIENT DIGITIZER (Techtronix) which is a machine that very rapidly (nanoseconds to picoseconds) registers and digitizes continuous processes.

The molecular beam space has a total volume of approximately six liters so that the chamber pressure does not momentarily increase sharply with each gas impulse. The pressure is maintained by means of a Roots pump with a capacity of 1000 $m^3/h$ and with suitable priming at a moderate pressure of approximately 1.3 ubars. The pressure in the drift space is maintained below 0.013 ubars by means of a diffusion pump.

As is otherwise shown in FIG. 3, the gas beam jet 1 is screwed as a component into an essentially hollow cylindrical valve 38 which in turn is fastened to a larger flange 43 by means of a one-piece flange 38 and a spacing ring 40, as well as gaskets 41, 42, the larger flange being provided with a pipe-shaped portion 44 (see FIG. 4). This pipe-shaped portion, which is not illustrated in FIG. 3, is located laterally at a distance from the vaporization and mixing chamber and supports the window 26 by means of a corresponding bracket 45.

Finally, the test results produced by the method and apparatus according to the present invention are shown with the aid of FIGS. 5–12. The results obtained are as follows:

The generation of the molecular beam was established with three different substances:

1. Anthracene,
2. Retinal (Vitamin A-Aldehyd), and
3. Tryptophan (an amino acid).

The measurement curves of FIGS. 7–12 are evidence of the fact that the thermally unstable molecules actually can be transformed without disintegration in a molecular beam.

The anthracene was identified in the molecular beam through fluorescence as well as the mass spectrum.

Figure 5:
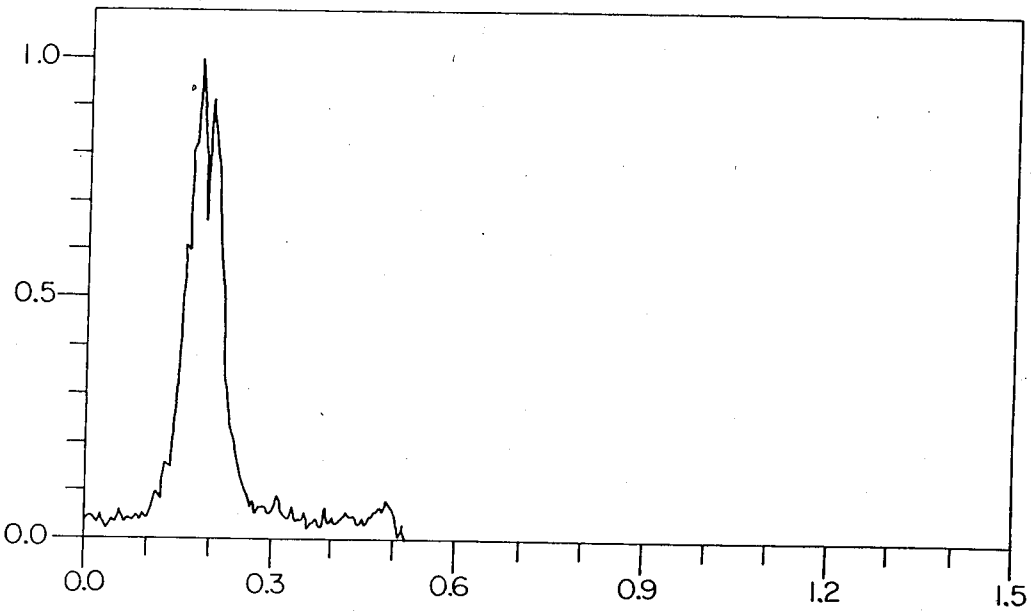

FIG. 5 shows a resonant fluorescent spectrum at 0—0 transition in the first stimulated electron condition of anthracene.

Typical test conditions were as follows:

Delay between valve opening and YAG-laser: 1.3 msec,

Delay between $CO_2$ laser and YAG-laser: 500 usec,

Argon pressure 0.5 bar, Photo-multiplier-voltage: 1800 V,

Power density of the $CO_2$-laser: approximately 1 $MW/cm^2$.

The small band—approximately 0.1 nm width—is characteristic for a cooled molecule at a few degrees Kelvin.

The following drawings (FIGS. 6–11) show the mass spectra which were obtained under the following conditions:

Delay between the valve opening and YAG-Laser: 880 usec,

Delay between $CO_2$-laser and the YAG-laser: 350 usec,

Power density of the $CO_2$-laser on the specimen: approximately 1.2 $MW/cm^2$,

Argon pressure 0.3–0.4 bar, Electron multiplier: 3000 V.

The substance was placed in the specimen canal of the vaporization temperature as a pellet.

Figure 6:
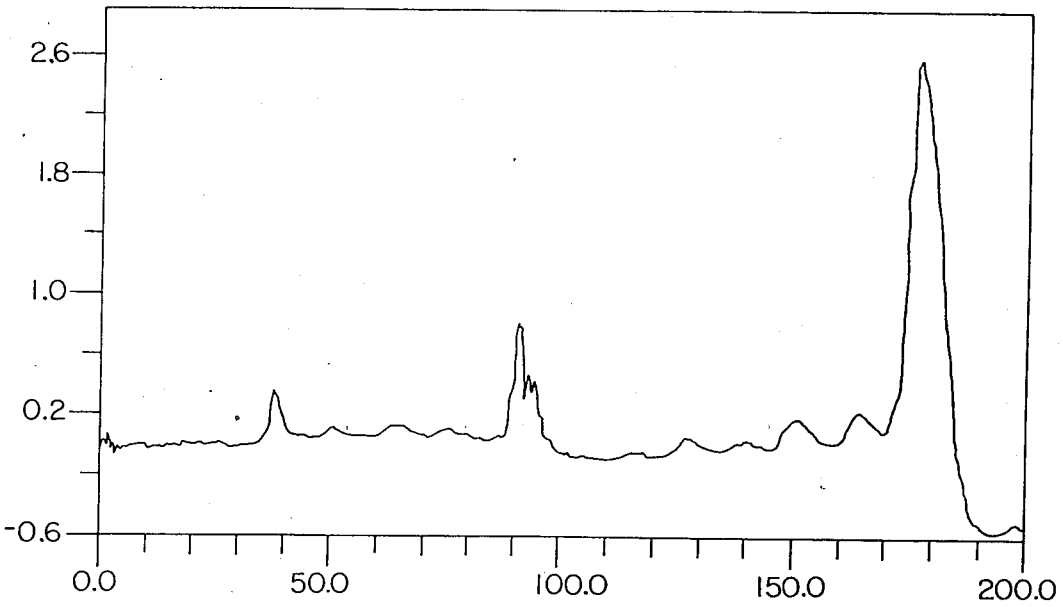

FIG. 6 shows the mass spectrum of anthracene. It contains substantially the basic mass as well as the standard peak of toluene, that would be mixed with argon in traces. The wavelength of the ionizing laser was 266 nm. It should be noted that an anthracene molecule is not thermally unstable, rather, it was selected only as an example to cause the adiabatic cooling. It was established that this adiabatic cooling also works with the introduction of the molecules into the carrier gas downstream of the gas beam jet.

Figure 7:
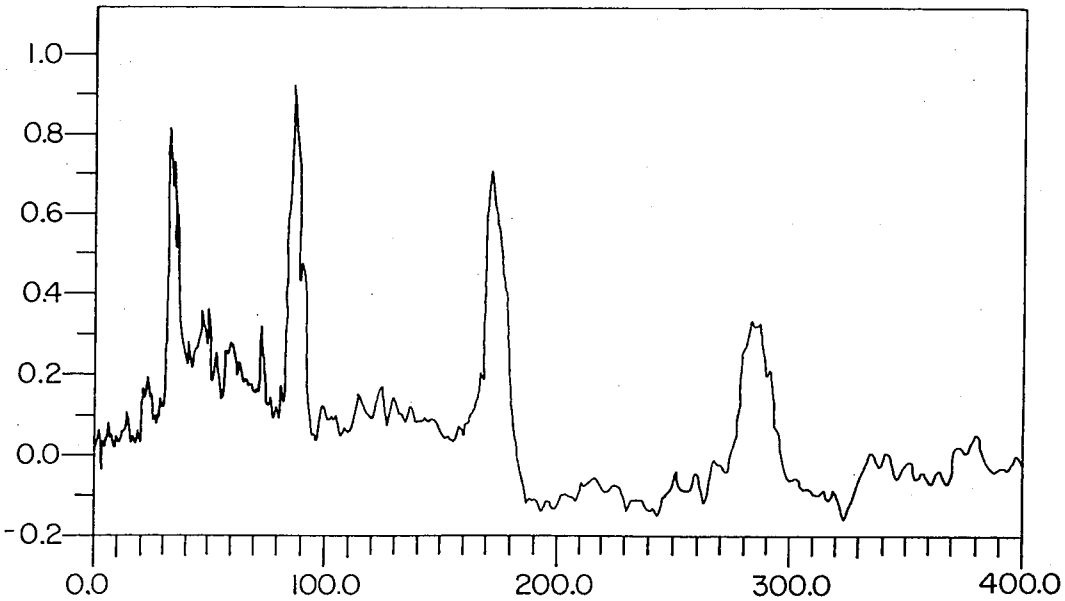

In FIG. 7, the basic masses of retinal, anthracene, and toluene appear simultaneously. The last two were still present from the previous test. Besides these, there appears a peak at mass 35, which apparently is traced to the fragmentation of retinal. The wavelength of this ionizing laser was 266 nm.

Figure 8:
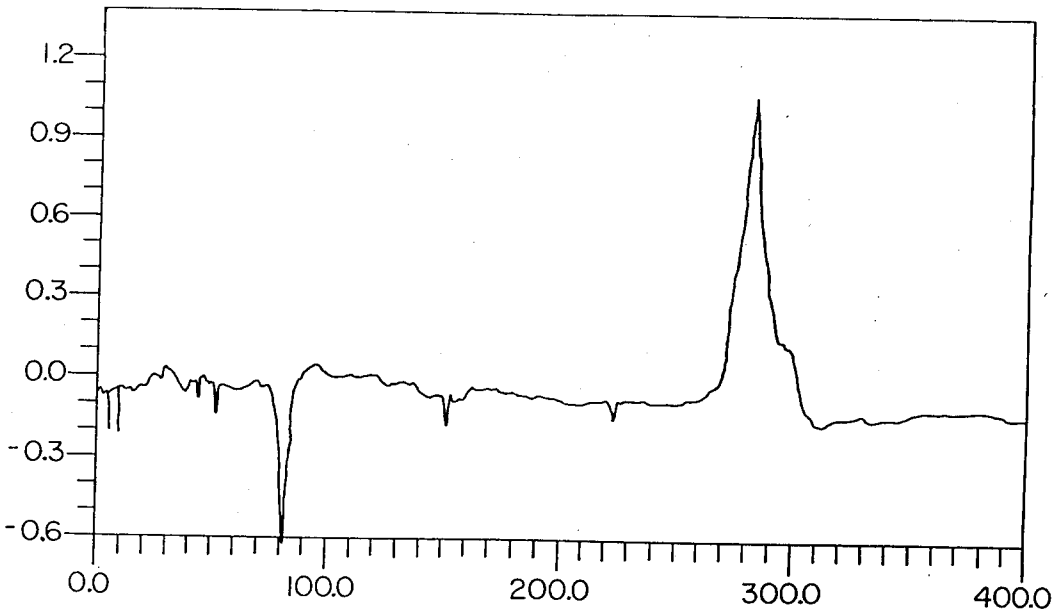

A spectrum in which the base ion of Retinal appears almost by itself is shown in FIG. 8. Here the vaporization chamber was thoroughly cleaned and then filled with fresh retinal specimens. The impacting wavelength was around 266 nm; however, the intensity was smaller than in FIG. 7.

Figure 9:
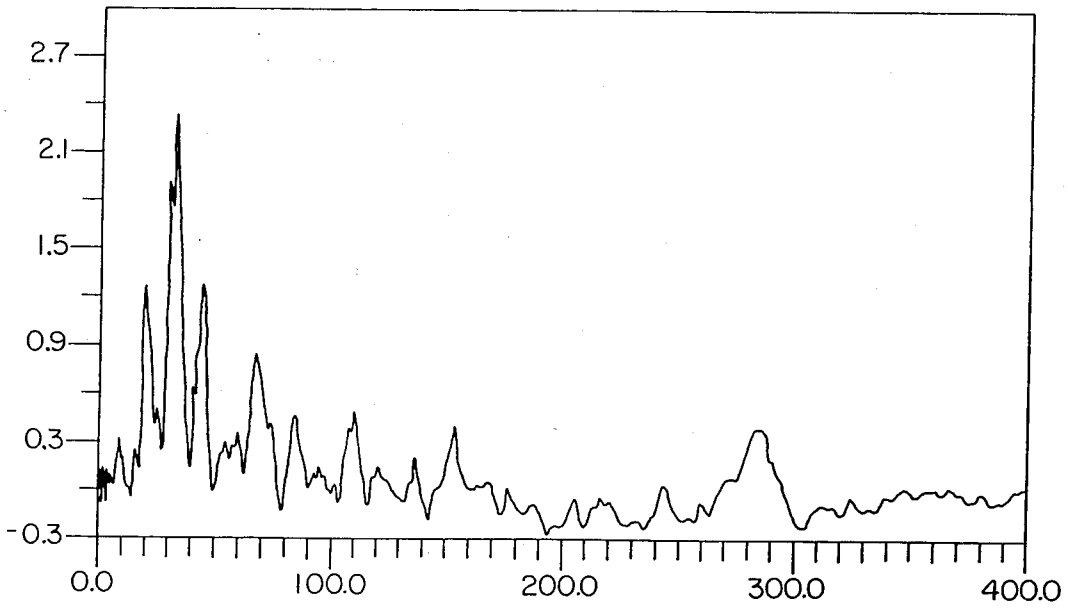
Figure 10:
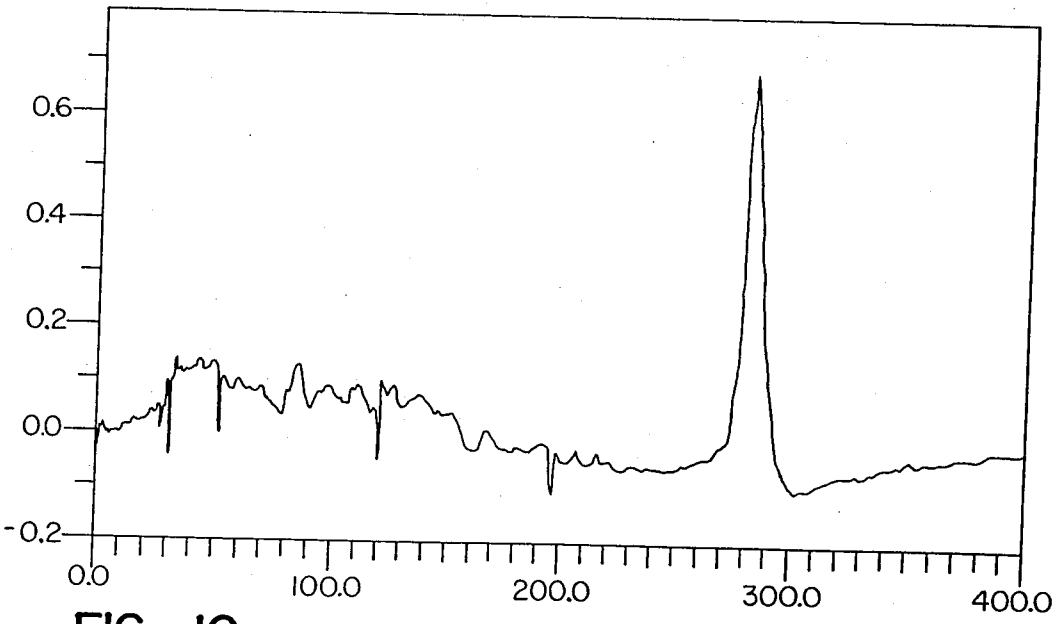

The retinal spectrum of the following two drawings was obtained with an ionizing wavelength of 355 nm and was obtained with energy densities that were higher in FIG. 9 and lower in FIG. 10. It can be seen that the fragmentation depends largely upon the intensity and is not traceable to the vaporization process.

Figure 11:
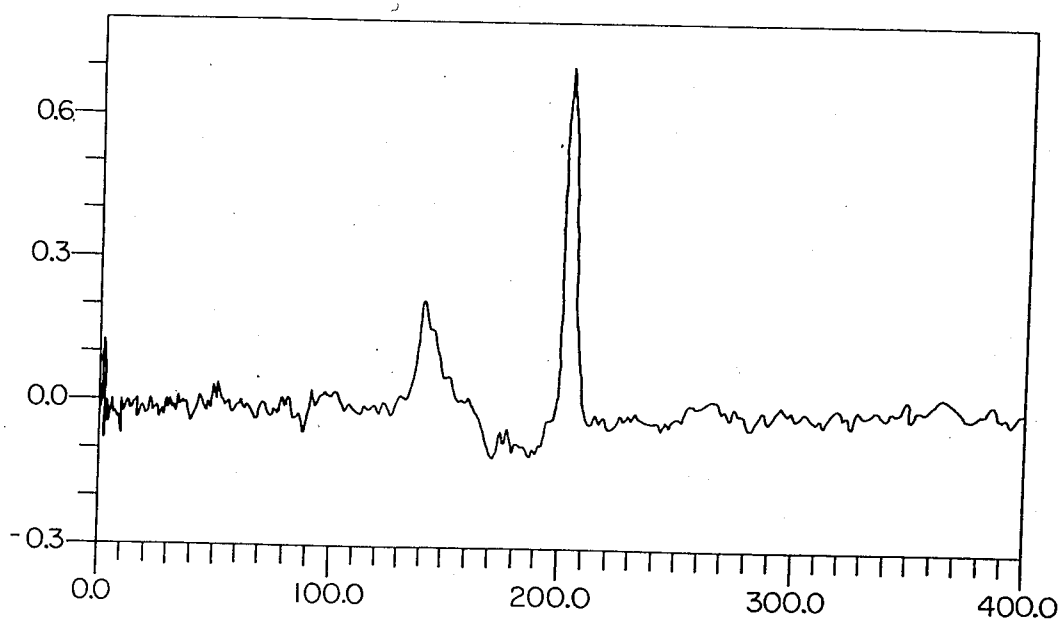
Figure 12:
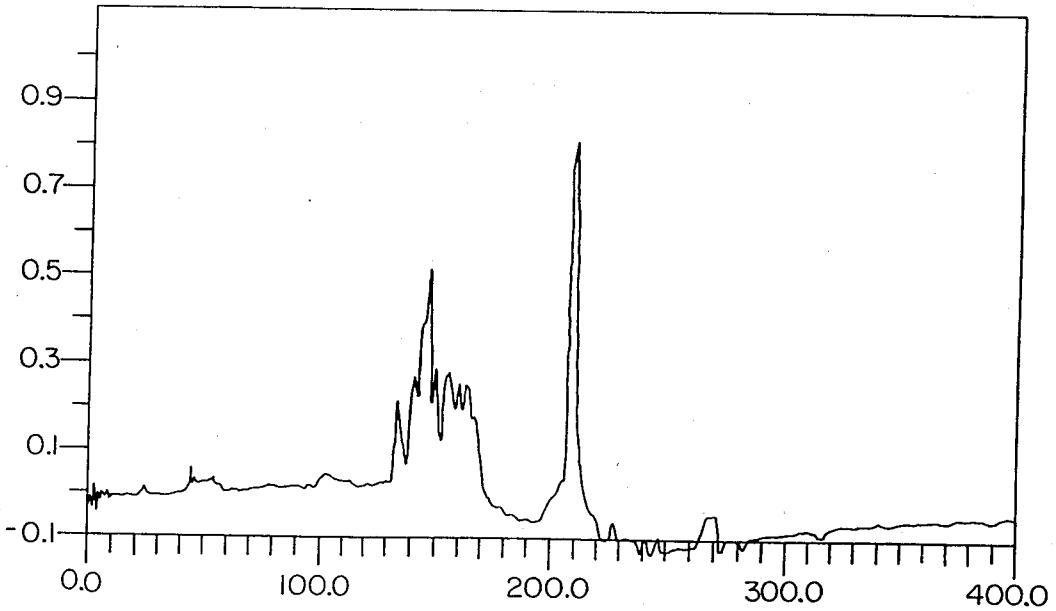

The last two drawings show the mass spectra of tryptophan. The ionizing wavelength was 266 nm. The spectrum in FIG. 11 is taken from a pellet, that of FIG. 12 is taken from a tryptophan coating on a copper base. The other conditions are the same.

The results clearly document that with the disclosed method, molecular beams can be produced from argon with intermixed thermally unstable molecules, for example, retinal and tryptophan.

Lastly, it should be noted that molecular beams in chemistry find many applications for establishing the molecular structures and reaction mechanisms in spectroscopy and mass spectroscopy, etc. The potential applications are so boundless that more chemical and biologically interesting molecules will be broken down in the beams. This number has increased through the novel apparatus and method of the present invention to include a considerable class of molecules that have not been accessible until now. This leads to new types of applications for molecular beams in scientific, analytical, and technical areas including those in chemistry, as well as in biology, medicine, and related sciences.

We claim:

1. A method for producing molecular beams in which (a) a test substance is transformed (vaporized) from a nongaseous phase to a gaseous phase through the application of energy;

(b) the free molecules of the test substance upon transformation are mixed with a carrier gas;

(c) the carrier gas with the molecules of the test substance is adiabatically cooled through expansion of the beam of the carrier gas;

characterized in that for the production of molecular beams with large thermally unstable molecules (d) the energy is produced in a pulsed form at such a level that the test substance is vaporized faster than it disintegrates;

(e) the temperature of the carrier gas beam in a region of the beam in which it begins to expand is adjusted to be substantially less than the disintegration temperature of the test substance;

(f) the molecules of the test substance set free are directly broken down in this region of the beam.

2. A method according to claim 1 characterized in that the test substance is vaporized by means of a pulsed laser beam.

3. A method according to claim 1 characterized in that the carrier gas beam is produced in a pulsed form.

4. A method according to claim 1 characterized in that the molecules are vaporized from a test surface at a vaporization position (13) extending substantially parallel to the axis of the gas carrier beam and adjacent to the exit opening (6) of a gas beam jet (1) that produces the gas carrier beam.

5. Apparatus for producing molecular beams comprising a gas beam jet (1) for producing a gas carrier beam, a carrier gas generator (4) for generation of the carrier gas at the gas beam jet (1), a vaporization and mixing chamber (2) for transformation of the test substance from a nongaseous to a gaseous phase (vaporization) and for mixing this phase with the carrier gas, and an energy generator (3) for the generation of vaporization energy for the vaporization and mixing chamber (2) characterized in that for production of the molecular beam which contains large thermally unstable molecules, (a) the carrier gas generator (4) generates the carrier gas of the gas jet (1) upstream of the latter with a temperature that is substantially less than the vaporization and correspondingly the disintegration temperature of the test substance;

(b) the vaporization and mixing chamber (2) at least in the part in which the mixing of the molecules for the carrier gas is produced is arranged downstream of the exit opening (6) of the gas carrier jet as well as adjacent the same; and (c) the energy generator (3) produces a high level of energy in pulsed form.

6. Apparatus according to claim 5 characterized in that the vaporization position (13) of the large thermally unstable molecules is located from the exit opening (6) of the gas beam jet (1), at a longitudinal distance (a) which is smaller than or equal to 20 times the effective diameter of the exit opening, and is located laterally of the exit opening (6) whereby the longitudinal distance (a) is that along the axis (5) of the gas beam jet (1) and the effective diameter is that of a circular exit opening of corresponding diameter.

7. A device according to claim 5 characterized in that the vaporization position (13) is located a transverse distance (b) from the axis (5) of the gas beam jet (1), the distance being smaller than or equal to 20 times (preferably 10 times) the effective diameter of the exit opening (6).

8. Apparatus according to claim 6 characterized in that the transverse distance (b) is smaller than half the longitudinal distance (a).

9. Apparatus according to claim 5 characterized in that the vaporization and mixing chamber (2) comprises a preferably cylindrical expansion channel (12) for the carrier gas beam connecting downstream to the exit opening (6) of the gas beam jet (1) and is provided at or in the walls of the vaporization position (13).

10. Apparatus according to claim 9 characterized in that the vaporization position (13) is provided in a test canal (15) positioned at an angle, preferably perpendicular, to the axis of the gas beam jet (1) and the test canal is formed in a side wall of the expansion canal 12.

11. Apparatus according to claim 9 characterized in that a laser beam canal (16) is formed in the side wall of the expansion canal (12) as an axial extension of the test canal (15).

12. Apparatus according to claim 10 characterized in that the separation (c) of the vaporization position (13) from the side walls of the expansion canal (12) is smaller than or equal to the diameter (d) of the test canal (15) whereby the test diameter is preferably the same as the latter.

13. Apparatus according to claim 5 characterized in that the gas beam jet (1) is formed by an electromagnetically actuated jet valve.

* * * * *